US009004977B2

(12) United States Patent
DeWitt et al.

(10) Patent No.: US 9,004,977 B2
(45) Date of Patent: Apr. 14, 2015

(54) AUXILIARY USER INTERFACE FOR A TRANSMIT CONTROLLER

(75) Inventors: Gary M. DeWitt, Plano, TX (US); Brad Shirley, Plano, TX (US); Chris S. Russell, Richardson, TX (US); Larry DeFauw, Dallas, TX (US)

(73) Assignee: Traxxas LP, McKinney, TX (US)

( * ) Notice: Subject to any disclaimer, the term of this patent is extended or adjusted under 35 U.S.C. 154(b) by 36 days.

(21) Appl. No.: 12/850,453

(22) Filed: Aug. 4, 2010

(65) Prior Publication Data

US 2011/0275274 A1 Nov. 10, 2011

Related U.S. Application Data

(60) Provisional application No. 61/331,745, filed on May 5, 2010.

(51) Int. Cl.
*A63H 30/04* (2006.01)

(52) U.S. Cl.
CPC ..... *A63H 30/04* (2013.01)

(58) Field of Classification Search
USPC ..... 446/454–456, 175; D21/566
See application file for complete search history.

(56) References Cited

U.S. PATENT DOCUMENTS

| | | | |
|---|---|---|---|
| 5,121,863 | A | 6/1992 | Kotitalo et al. |
| 5,252,965 | A | 10/1993 | Gidwani et al. |
| 5,438,936 | A | 8/1995 | Wang |
| 5,457,745 | A | 10/1995 | Wang |
| 5,555,302 | A | 9/1996 | Wang |
| 5,787,168 | A | 7/1998 | Lien |
| 5,788,202 | A | 8/1998 | Richter |
| 5,836,563 | A | 11/1998 | Hsin-Yung |
| 5,903,645 | A | 5/1999 | Tsay |
| 5,937,065 | A | 8/1999 | Simon et al. |
| 6,127,941 | A | 10/2000 | Van Ryzin |

(Continued)

FOREIGN PATENT DOCUMENTS

| | | | |
|---|---|---|---|
| CN | 101505380 | A | 8/2009 |
| DE | 10 2007 038 666 | A1 | 2/2009 |

(Continued)

OTHER PUBLICATIONS

Booker, Jim; "The JR Data Transfer Program Makes Model Setup Easy"; Horizon Hobby; Aug. 29, 2008; http://www.horizonhobby.com/Articles/Article.aspx?ArticleID=1827.

(Continued)

*Primary Examiner* — Jay Liddle
*Assistant Examiner* — Alex F. R. P. Rada, II
(74) *Attorney, Agent, or Firm* — CARR Law Firm PLLC

(57) ABSTRACT

In an embodiment, a transmit controller compatible with an auxiliary user interface device is provided. The transmit controller has a memory with operational parameters, a control user interface, an auxiliary user interface connector, and a transmit controller processor. The transmit controller processor is configured to transmit the operational parameters to the auxiliary user interface device and modify the operational parameters in accordance with a parameter instruction from the auxiliary user interface device. The transmit controller processor is further configured to receive a control instruction from the control user interface, determine an output signal based on the control instruction and the one or more operational parameters, and transmit the output signal to the model vehicle.

24 Claims, 9 Drawing Sheets

(56) References Cited

U.S. PATENT DOCUMENTS

| | | | | |
|---|---|---|---|---|
| 6,229,891 | B1 | 5/2001 | Chen | |
| 6,293,798 | B1 * | 9/2001 | Boyle et al. | 434/29 |
| 6,658,328 | B1 | 12/2003 | Alrabady et al. | |
| 6,741,684 | B2 | 5/2004 | Kaars | |
| 6,785,567 | B2 | 8/2004 | Kato | |
| 6,944,294 | B2 | 9/2005 | Tsay | |
| 6,959,899 | B2 | 11/2005 | Yeh | |
| 7,080,812 | B2 | 7/2006 | Wadsworth et al. | |
| 7,158,092 | B2 | 1/2007 | Shen | |
| 7,174,518 | B2 | 2/2007 | Kim | |
| 7,224,262 | B2 | 5/2007 | Simon et al. | |
| 7,231,294 | B2 | 6/2007 | Bodin et al. | |
| 7,233,844 | B2 | 6/2007 | Peltz et al. | |
| 7,268,664 | B2 | 9/2007 | Tanaka et al. | |
| 7,307,573 | B2 | 12/2007 | Choi | |
| 7,391,320 | B1 | 6/2008 | Beard et al. | |
| 7,407,143 | B1 | 8/2008 | Chen | |
| 7,418,097 | B2 | 8/2008 | Chang | |
| 7,486,193 | B2 | 2/2009 | Elwell | |
| 7,537,190 | B2 | 5/2009 | Fan | |
| 7,614,595 | B2 | 11/2009 | Richter | |
| 7,681,194 | B2 | 3/2010 | Van Ee et al. | |
| 7,828,259 | B2 | 11/2010 | Wang et al. | |
| 7,967,262 | B2 | 6/2011 | O'Brien et al. | |
| 8,138,894 | B2 | 3/2012 | Kato et al. | |
| 8,240,628 | B2 | 8/2012 | Huang | |
| 8,262,070 | B2 | 9/2012 | Liu | |
| 8,282,063 | B2 | 10/2012 | Ou et al. | |
| 8,376,301 | B2 | 2/2013 | Fan | |
| 8,405,974 | B2 | 3/2013 | Sayavong | |
| 8,500,080 | B2 | 8/2013 | Hu | |
| 2001/0042631 | A1 | 11/2001 | Carrier | |
| 2002/0187726 | A1 | 12/2002 | Yamaguchi | |
| 2003/0148703 | A1 | 8/2003 | Scott et al. | |
| 2004/0018800 | A1 * | 1/2004 | Caiozza | 446/454 |
| 2004/0077284 | A1 * | 4/2004 | Bonilla et al. | 446/454 |
| 2004/0091102 | A1 | 5/2004 | Tsay | |
| 2004/0179469 | A1 | 9/2004 | Attar et al. | |
| 2004/0179678 | A1 | 9/2004 | Hsu Li | |
| 2005/0048918 | A1 | 3/2005 | Frost et al. | |
| 2005/0088275 | A1 | 4/2005 | Valoteau et al. | |
| 2005/0168373 | A1 | 8/2005 | Mukaida | |
| 2005/0236536 | A1 | 10/2005 | Fan | |
| 2006/0113428 | A1 | 6/2006 | Choi | |
| 2006/0145039 | A1 | 7/2006 | Shawver | |
| 2006/0183405 | A1 | 8/2006 | Mathews | |
| 2006/0293102 | A1 * | 12/2006 | Kelsey | 463/37 |
| 2007/0001805 | A1 | 1/2007 | Utter et al. | |
| 2007/0035412 | A1 | 2/2007 | Dvorak et al. | |
| 2007/0262223 | A1 | 11/2007 | Wang et al. | |
| 2007/0284500 | A1 | 12/2007 | Fan | |
| 2007/0293124 | A1 * | 12/2007 | Smith et al. | 446/454 |
| 2008/0285628 | A1 * | 11/2008 | Gizis et al. | 375/135 |
| 2009/0195407 | A1 | 8/2009 | Nakano et al. | |
| 2009/0262002 | A1 | 10/2009 | Alexander et al. | |
| 2009/0294617 | A1 | 12/2009 | Stacey et al. | |
| 2011/0288696 | A1 | 11/2011 | Lefebure | |
| 2012/0015686 | A1 * | 1/2012 | Krupnik | 455/550.1 |

FOREIGN PATENT DOCUMENTS

| | | | |
|---|---|---|---|
| EP | 1736948 | A1 | 12/2006 |
| EP | 1973313 | A1 | 9/2008 |
| EP | 2296122 | A2 | 3/2011 |
| EP | 2384796 | A1 | 11/2011 |
| EP | 2416049 | A2 | 2/2012 |
| JP | 5086759 | A | 4/1993 |
| JP | 5106376 | A | 4/1995 |
| JP | 2002-345050 | A | 11/2002 |
| JP | 2004-64418 | A | 2/2004 |
| JP | 2004-064418 | A | 2/2004 |
| JP | 2009-177767 | A | 8/2009 |
| TW | M395337 | U1 | 12/2010 |
| WO | WO 2004/052484 | A2 | 6/2004 |
| WO | WO 2010/042219 | A2 | 5/2010 |

OTHER PUBLICATIONS

Booker, Jim; "The JR Data Transfer Program Makes Model Setup Easy"; Horizon Hobby; Aug. 29, 2008; http://www.jrradios.com/Articles/Article.aspx?ArticleID=1827.

"JR Data Transfer How to: . . . Set Up Dual Aileron and Elevator"; Transcript of video presented by Horizon Hobby Aug. 29, 2008 at http://www.horizonhobby.com/Articles/Article.aspx?ArticleID=1827.

Parry, Bill; "Clip-on Wireless Telemetry from Eagle Tree Systems!", message posted Apr. 27, 2004 by 'billpa', "Bill From Eagle Tree Systems here, . . . "; http://forums.radiocontrolzone.com/showthread.php?t=165955.

European Search Report; EP Appl'n No. 11164210.4; Sep. 19, 2011.

Horizon Hobby; "PC Data Transfer by JR"; Aug. 2008; http://www.horizonhobby.com/Products/Default.aspx?ProdID=JRPA310#quickOverview.

Horizon Hobby; "JR PC Data Transfer Instruction Manual"; Horizon Hobby Inc., Champaign IL; Aug. 2008.

Eagle Tree Systems; "Preliminary Information for the Seagull Wireless Telemetry System"; Eagle Tree Systems, Bellevue WA; Aug. 12, 2004; http://web.archive.org/web/20040812123921/http://eagletreesystems.com/News/news.html.

Eagle Tree Systems; "Wireless Telemetry and Advanced Data Recording for Model Cars/Trucks"; Eagle Tree Systems, Bellevue WA; Jul. 10, 2004; http://www.eagletreesystems.com/Car/car.html.

Eagle Tree Systems; "Instruction Manual for the USB Flight Data Recorder, ver. 1.01"; Eagle Tree Systems, Bellevue WA; Jun. 21, 2003.

Eagle Tree Systems; "Instruction Manual for the USB Flight Data Recorder, ver. 3.9"; Eagle Tree Systems, Bellevue WA; Jan. 15, 2010.

Spektrum RC; "ModelMatch"; Horizon Hobby Inc., Champaign IL; Oct. 2009; http://www.spektrumrc.com/DSM/Technology/modelmatch.aspx.

Spektrum; "3-Channel, 4-Model Memory DSM Racing System" instruction manual; Horizon Hobby Inc., Champaign IL; Oct. 2009.

Futaba; "FASST 2.4GHz Module & R603FS Receiver" brochure; Great Planes Model Distr. Co., Champaign IL, May 2006.

Futaba; "Futaba 2.4GHz FASST System Features"; May 2007 Hobbico Inc.; http://2.4gigahertz.com/features/features.html.

Futaba; "3GR-2.4GHz System" manual; Futaba Corp., Japan, May 2007.

Futaba; "3PM w/2.4GHz FASST System" brochure; Great Planes Model Distr. Co., Champaign IL, May 2007; www.2.4gigahertz.com.

Futaba; "3PM-2.4GHz System" manual; Futaba Corp., Japan, May 2007.

Futaba; "4PK 4-Channel Computer Systems" brochure; Great Planes Model Distr. Co., Champaign IL, May 2007.

Futaba; "6EX w/2.4GHz FASST System" brochure; Great Planes Model Distr. Co., Champaign IL, May 2007.

Futaba; "6EX-2.4GHz Instruction Manual"; Futaba Corp., Japan, May 2007.

Futaba; "Futaba Model Data Converter" manual; Futaba Corp., Japan, May 2008.

Futaba; "7C 7-Channel FASST Computer System" brochure; Great Planes Model Distr. Co., Champaign IL, May 2007.

Futaba; "7C-2.4GHz Instruction Manual"; Futaba Corp., Japan, May 2007.

Futaba; "12FG 12-Channel Computer Systems" brochure; Great Planes Model Distr. Co., Champaign IL, May 2007.

Futaba; "FASST Air System TM-7 RF Module and R607FS Receiver Instruction Manual"; Futaba Corp., Japan, May 2007.

Futaba; "FASST Air System TM-14 RF Module and R6014FS Receiver Instruction Manual"; Futaba Corp., Japan, May 2007.

Futaba; "FASST Air System TM-8 RF Module and R608FS Receiver Instruction Manual"; Futaba Corp., Japan, May 2008.

(56) References Cited

OTHER PUBLICATIONS

Futaba; "14MZ 14-Channel Computer Systems" brochure; Great Planes Model Distr. Co., Champaign IL, May 2008.
Futaba; "4PK-2.4GHz System" manual; Futaba Corp., Japan, May 2008.
Futaba; "Manual Changes—Instruction Manual—Throttle-cut function"; Futaba Corp., Japan, May 2008.
Futaba; "R6004FF" receiver manual; Futaba Corp., Japan, May 2008.
Futaba; 10CAP/10CHP/10CP 10-Channel Radio Control System Instruction Manual; Futaba Corp., Japan, May 2008.
Futaba; "3PM-X 3-Channel 2.4GHz FASST Computer System" brochure; Great Planes Model Distr. Co., Champaign IL, Hobbico Inc. May 2009.

* cited by examiner

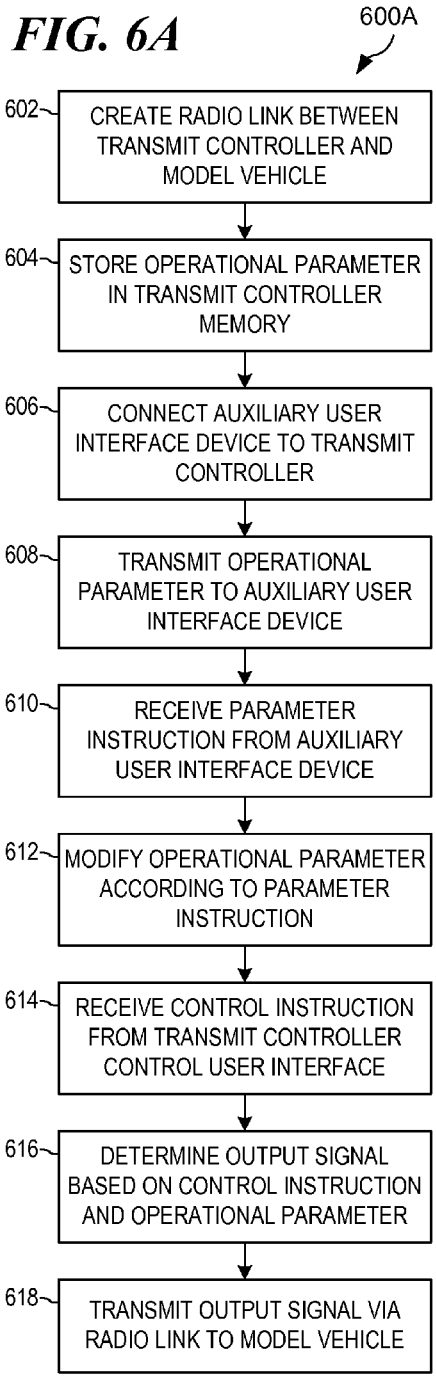
FIG. 6A
600A
602
CREATE RADIO LINK BETWEEN TRANSMIT CONTROLLER AND MODEL VEHICLE
604
STORE OPERATIONAL PARAMETER IN TRANSMIT CONTROLLER MEMORY
606
CONNECT AUXILIARY USER INTERFACE DEVICE TO TRANSMIT CONTROLLER
608
TRANSMIT OPERATIONAL PARAMETER TO AUXILIARY USER INTERFACE DEVICE
610
RECEIVE PARAMETER INSTRUCTION FROM AUXILIARY USER INTERFACE DEVICE
612
MODIFY OPERATIONAL PARAMETER ACCORDING TO PARAMETER INSTRUCTION
614
RECEIVE CONTROL INSTRUCTION FROM TRANSMIT CONTROLLER CONTROL USER INTERFACE
616
DETERMINE OUTPUT SIGNAL BASED ON CONTROL INSTRUCTION AND OPERATIONAL PARAMETER
618
TRANSMIT OUTPUT SIGNAL VIA RADIO LINK TO MODEL VEHICLE

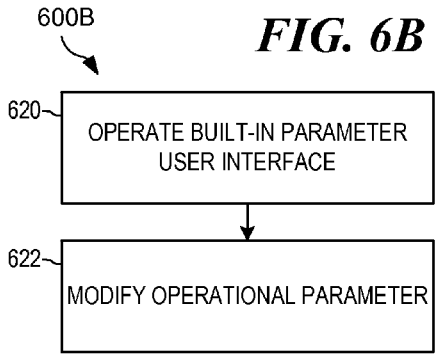
600B
FIG. 6B
620
OPERATE BUILT-IN PARAMETER USER INTERFACE
622
MODIFY OPERATIONAL PARAMETER

AUXILIARY USER INTERFACE FOR A TRANSMIT CONTROLLER

CROSS-REFERENCE TO RELATED APPLICATIONS

This application relates to, and claims the benefit of the filing date of, co-pending U.S. provisional patent application Ser. No. 61/331,745 entitled AUXILIARY USER INTERFACE FOR A MODEL VEHICLE, filed May 5, 2010. The entire contents of application Ser. No. 61/331,745 are incorporated herein by reference for all purposes.

TECHNICAL FIELD

The present invention relates to model vehicle transmit controllers and, more particularly, to user interfaces for model vehicle transmit controllers.

BACKGROUND

A radio control model vehicle, such as a radio control automobile, boat, or airplane, may be controlled remotely by a transmit controller. A transmit controller is often an exclusively hardware device with an exclusively hardware built-in user interface. In a transmit controller, all user input may be received through mechanical hardware components such as knobs, dials, wheels, and switches. Output to the user might be provided solely through labeled positions of the hardware components and a few LED's.

The built-in user interface of a transmit controller may be separated into two parts: a control user interface and a parameter user interface. The control user interface directly controls the movement of the model vehicle. For example, in a typical model automobile, the control user interface includes a steering wheel and a throttle trigger. When the user turns the steering wheel, the wheels of the vehicle may move accordingly. When the user displaces the trigger toward the grip, the vehicle may accelerate, and when the user displaces the trigger away from the grip, the vehicle may brake.

The parameter user interface allows a user to set operational parameters which indirectly control the operation of the vehicle. These parameters may be stored a memory of the transmit controller. The parameters may affect how the transmit controller translates input from the control user interface into output to the model vehicle. The transmit controller can be said to "determine" an output signal to the model vehicle based on the parameters and the input to the control user interface. In other words, the parameters may determine whether or not the transmit controller modifies a control instruction from the control user interface and, if the control instruction is modified, the parameters may determine how the control instruction is modified.

For example, some model vehicles have reversed steering servos, meaning the vehicle will turn left when the transmit controller directs it to turn right, and turn right when the transmit controller directs it to turn left. Accordingly, a user intending to turn the vehicle to the right will observe the vehicle turn to the left, and vice versa. To address this issue, a transmit controller may have a servo reversing parameter stored in memory. If the servo reversing parameter is set to off, the transmit controller may transmit signals normally. If the servo reversing parameter is set to on, the transmit controller may reverse the left/right instructions transmitted to the vehicle, compensating for the vehicle's the reversed steering servo. Accordingly, a user instruction to turn the vehicle to the left will cause the transmit controller to instruct the vehicle to turn to the right, which because of the reversed steering servo will cause the vehicle to turn to the left. Likewise, a user instruction to turn the vehicle to the right will cause the transmit controller to instruct the vehicle to turn to the left, which because of the reversed steering servo will cause the vehicle to turn to the right.

For binary parameters such as servo reversing, a built-in switch in the transmit controller may be acceptable. However, with more complex parameters, typical hardware user interface components may be unwieldy. For instance, an acceleration curve parameter may determine how much the transmit controller will instruct the model vehicle to accelerate in response to varying amounts of movement of the throttle trigger. To specify an acceleration curve, with only dials, switches, and so on can be difficult for most users. In addition, if the user cannot graphically view the acceleration curve the user may have no way to determine if the user has set the acceleration curve correctly.

Typical hardware user interface components may also have limited capability to provide feedback to the user. Informing a user of vehicle speed, battery voltage, engine RPM, and so on with only labels and a few LED's can be difficult. A transmit controller with a built-in graphical user interface could provide a user with a more advanced user interface. However, producing such a transmit controller may be cost-prohibitive. The addition of a graphical display and versatile user controls would require additional components that would add significantly to the cost of the transmit controller. In addition, powering these components would significantly reduce the transmit controller's battery life.

Thus, a need exists for the addition of a better user interface to a transmit controller without the extensive addition of components to the transmit controller.

SUMMARY OF INVENTION

In an embodiment, a transmit controller compatible with an auxiliary user interface device is provided. The transmit controller has a memory with operational parameters, a control user interface, an auxiliary user interface connector, and a transmit controller processor. The transmit controller processor is configured to transmit the operational parameters to the auxiliary user interface device and modify the operational parameters in accordance with a parameter instruction from the auxiliary user interface device. The transmit controller processor is further configured to receive a control instruction from the control user interface, determine an output signal based on the control instruction and the one or more operational parameters, and transmit the output signal to the model vehicle.

DESCRIPTION OF DRAWINGS

For a more complete understanding of the present invention and the advantages thereof, reference is now made to the following Detailed Description taken in conjunction with the accompanying drawings, in which:

FIG. 6A and 6B depict exemplary methods of operating with an auxiliary user interface device in accordance with an embodiment of the present invention.

DETAILED DESCRIPTION OF THE INVENTION

Figure 1:
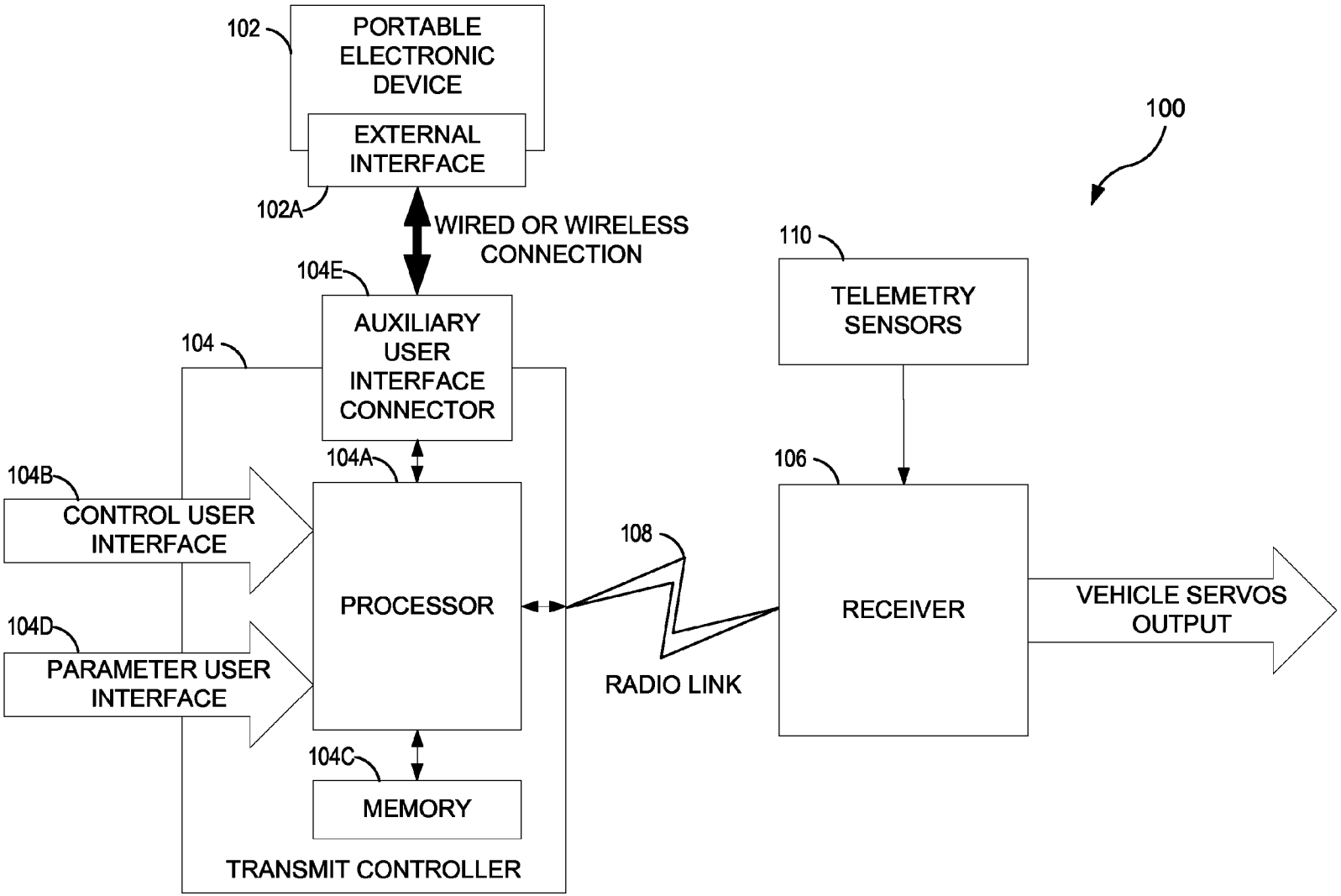
FIG. 1 depicts a combination of a portable electronic device, transmit controller, and receiver in accordance with an exemplary embodiment of the present invention.

In the following discussion, numerous specific details are set forth to provide a thorough understanding of the present invention. However, those skilled in the art will appreciate that the present invention may be practiced without such specific details. In other instances, well-known elements have been illustrated in schematic or block diagram form in order not to obscure the present invention in unnecessary detail. Additionally, for the most part, specific details, and the like have been omitted inasmuch as such details are not considered necessary to obtain a complete understanding of the present invention, and are considered to be within the understanding of persons of ordinary skill in the relevant art.

In accordance with the present invention, a transmit controller may have the capability to communicate with a portable electronic device. The transmit controller may function alone, without the portable electronic device, and provide a basic, built-in non-graphical parameter user interface. To provide an expanded parameter user interface, a portable electronic device may be connected to the transmit controller and serve as an auxiliary user interface. The portable electronic device may be attached to the transmit controller where the user may interact with the portable electronic device while using the transmit controller.

Portable electronic devices may be devices such as mobile smart phones, personal digital assistants, and digital music players. These devices are commonly available and commonly programmable. By using a portable electronic device, the transmit controller may present a graphical user interface with only the hardware necessary to communicate with the portable electronic device, rather than a built-in LCD display, touch screen, audio output, and so on. A user who owns a transmit controller and a portable electronic device may save the expense of additional hardware components in the transmit controller by utilizing the hardware components available in the portable electronic device.

Many portable electronic devices are capable of providing rich graphical user interfaces comparable to the graphical user interfaces of personal computers. For input, these devices may have a touch screen or keyboard. These devices may have high-resolution displays with the same range of colors as a personal computer monitor. These devices are often usable as music players and consequently may be capable of producing high-quality audio output. Some devices may have vibration capabilities.

Many portable electronic devices also have an external interface for communication with an external device. The external device is often a personal computer. Through the external interface, the portable electronic device may communicate with the personal computer and vice versa. In an exemplary embodiment of the present invention, a portable electronic device communicates with a model vehicle transmit controller using the external interface, allowing the portable electronic device to function as an auxiliary user interface for a transmit controller.

With reference to FIG. 1, depicted is a combination 100 of a portable electronic device 102, transmit controller 104, and receiver 106 in accordance with an exemplary embodiment of the present invention. The transmit controller 104 and receiver 106 may be in radio communication through radio link 108 as is known in the art. Despite their names, both transmit controller 104 and receiver 106 may be capable of both transmitting and receiving radio communications. Thus, transmit controller 104 and receiver 106 may each be called a "transceiver," but to distinguish between the two devices the terms "transmit controller" and "receiver" will be used herein.

The portable electronic device 102 may be a smart phone or digital music player. Exemplary portable electronic devices are the iPhone and iPod Touch produced by Apple Inc. Both of these exemplary portable electronic devices may accept user input via a touch screen. Portable electronic device 102 may be connected to transmit controller 104 through external interface 102A of portable electronic device 102. External interface 102A may be a conventional hardware interface of portable electronic device 102, such as the connection used by portable electronic device 102 to communicate with a personal computer.

Transmit controller 104 may have a dock for storing portable electronic device 102, so that the user may more easily concurrently operate both devices. A typical portable electronic device 102 may be physically smaller in volume, or at least not substantially larger in volume, than a typical transmit controller 104. The reason is that a user may be expected to operate portable electronic device 102 while simultaneously controlling a vehicle with transmit controller 104. If transmit controller 104 is designed to be held with both hands, a substantially larger portable electronic device 102 may be difficult for the user to work with.

Portable electronic device 102 may execute a software application for communication with transmit controller 104. The software application may be provided to portable electronic device 102 through an Internet download. Internet download is a common software application delivery method for many portable electronic devices.

Transmit controller 104 may have processor 104A. Processor 104A may determine what output signal is transmitted to receiver 106 over radio link 108. The output signal may be determined from user input from control user interface 104B and one or more parameters stored in memory 104C. Control user interface 104B may be components of transmit controller 104 which permit a user to directly control the operations of a model vehicle. These components may include a steering wheel and throttle trigger. Once processor 104A determines the output signal that should be transmitted, it may send the signal through a radio frequency module.

Transmit controller 104 may connect to external interface 102A of portable electronic device 102 through auxiliary user interface connector 104E. The connection between external interface 102A and auxiliary user interface connector 104E may be wired or wireless, and a wired connection may be through direct contact or through a cable between the two devices. In some embodiments, auxiliary user interface connector 104E may include a cable, with one end of the cable permanently attached to transmit controller 104.

A wireless connection between external interface 102A and auxiliary user interface connector 104E may be a Bluetooth connection. The wireless connection between external interface 102A and auxiliary user interface connector 104E may also be a wireless local area network connection using a standard such as IEEE 802.11, also known as Wi-Fi. External interface 102A and auxiliary user interface connector 104E may include Bluetooth or 802.11 transceivers. Portable electronic device 102 may be a mobile smart phone, and many mobile smart phones include Bluetooth and 802.11 transmitters. Auxiliary user interface 104E may utilize a Bluetooth or 802.11 transceiver built into transmit controller 104 or an external dongle with a Bluetooth or 802.11 transceiver.

One advantage of using a wireless connection between external interface 102A and auxiliary user interface connector 104E is that a single transmit controller 104 may easily support different types of portable electronic devices 102. Different portable electronic device manufacturers may use different physical connections for their portable electronic devices. Accordingly, transmit controller 104 may be require a separate external interface 102A for each type of portable electronic device. In contrast, a wireless standard such as Bluetooth or 802.11 may typically be supported by a variety of devices.

Another advantage of using a wireless connection between external interface 102A and auxiliary user interface connector 104E is that the wireless connection permits portable electronic device 102 to be separated from transmit controller 104. A user's pit man, for example, could use portable electronic device 102 while the user continues to operate the vehicle with transmit controller 104. Further, if a wireless local area network connection such as IEEE 802.11 is used, multiple portable electronic devices 102 may be in communication with a single transmit controller 104 at the same time. Therefore, a user and the user's pit man may each have a functioning portable electronic device 102 while the user is controlling the vehicle with transmit controller 104.

When portable electronic device 102 is not connected, the user may modify the parameters in memory 104C through parameter user interface 104D. Parameter interface 104D may allow the user to modify basic parameters such as servo reversing, steering sensitivity, and throttle sensitivity. These basic parameters may be sufficient for the user to operate the model vehicle, but may be limited by the input and output capabilities of parameter interface 104D.

When the user connects portable electronic device 102 to auxiliary user interface connector 104E, portable electronic device 102 may provide the user with a graphical user interface permitting the user to gain access to additional parameters and additional feedback. The graphical user interface may also provide the user with access to the same parameters and feedback available through transmit controller 104 alone. Parameter user interface 104D may become inoperable when portable electronic device 102 is connected.

To display a parameter, auxiliary user interface device 102 may request the parameter from processor 104A. In response to the request, processor 104A may transmit the parameter from memory 104C to portable electronic device 102.

When the user chooses to modify a parameter using portable electronic device 102, portable electronic device 102 transmits a parameter instruction to transmit controller 104. The parameter instruction instructs processor 104A to modify the parameter in memory 104C according to the user's input.

Portable electronic device 102 may transmit signals to and receive signals from the vehicle through transmit controller 104. Through the graphical user interface provided by portable electronic device 102, the user may set the various parameters stored in memory 104C. The user may set be able to set the parameters in memory 104C while operating a model vehicle, while not operating a model vehicle, or both.

Telemetry sensors 112 may be mounted on the model vehicle. Telemetry data captured by telemetry sensors 112 may be provided to receiver 106, which may transmit the data to transmit controller 104 over radio link 108. The telemetry data may include data such as motor temperature, motor RPM, speed, battery voltage, and fuel level. Transmit controller 104 may then provide the data to portable electronic device 102, if it is attached. Telemetry data may be provided to the user through built-in components of transmit controller 104, but the inclusion of portable electronic device 102 can greatly improve the presentation of the telemetry data to the user. For example, in addition to using its graphical display, portable electronic device 102 may provide feedback to the user through its audio and vibration capabilities.

An exemplary parameter which takes advantage of the output capabilities of the auxiliary user interface is an accelerometer sensor in the model vehicle. The accelerometer sensor can be used to detect bumps, collisions, jumps, and landings of the model vehicle. The accelerometer sensor can provide the acceleration data to portable electronic device 102 through receiver 106, radio link 108, and transmit controller 104. Portable electronic device 102 may vibrate during periods of sudden changes in acceleration of the model vehicle, providing additional feedback to the user. Because the feedback is tactile, the user may receive the feedback even when the user is not looking at transmit controller 104 or portable electronic device 102.

Portable electronic device 102 may communicate with processor 104A of transmit controller 104. Portable electronic device 102 may transmit write commands to processor 104A, instructing processor 104A to modify the value of a particular parameter in the memory of transmit controller 104. Portable electronic device 102 may transmit read commands to processor 104A, instructing processor 104A to provide portable electronic device 102 with the value of a particular parameter in memory 104C or a particular telemetry value recorded by telemetry sensors 110. Portable electronic device 102 may also periodically transmit values to portable electronic device 102, eliminating the need for read commands.

With reference to FIGS. 2A-2G, depicted is a transmit controller 200 with an attached portable electronic device 202 providing an auxiliary user interface in accordance with an embodiment of the present invention. Each of FIGS. 2A-2G is to scale, showing the relative proportions of an exemplary embodiment of the present invention. Transmit controller 200 includes steering wheel 204 and throttle trigger 206. Steering wheel 204 and throttle trigger 206, together with any other user input components on transmit controller 200, may make up the control user interface for transmit controller 200. Through the control user interface, a user may drive a model vehicle in radio communication with transmit controller 200. A user may normally drive the model vehicle using two hands, with a right hand operating steering wheel 204 and a left hand operating throttle trigger 206.

Figure 2A:
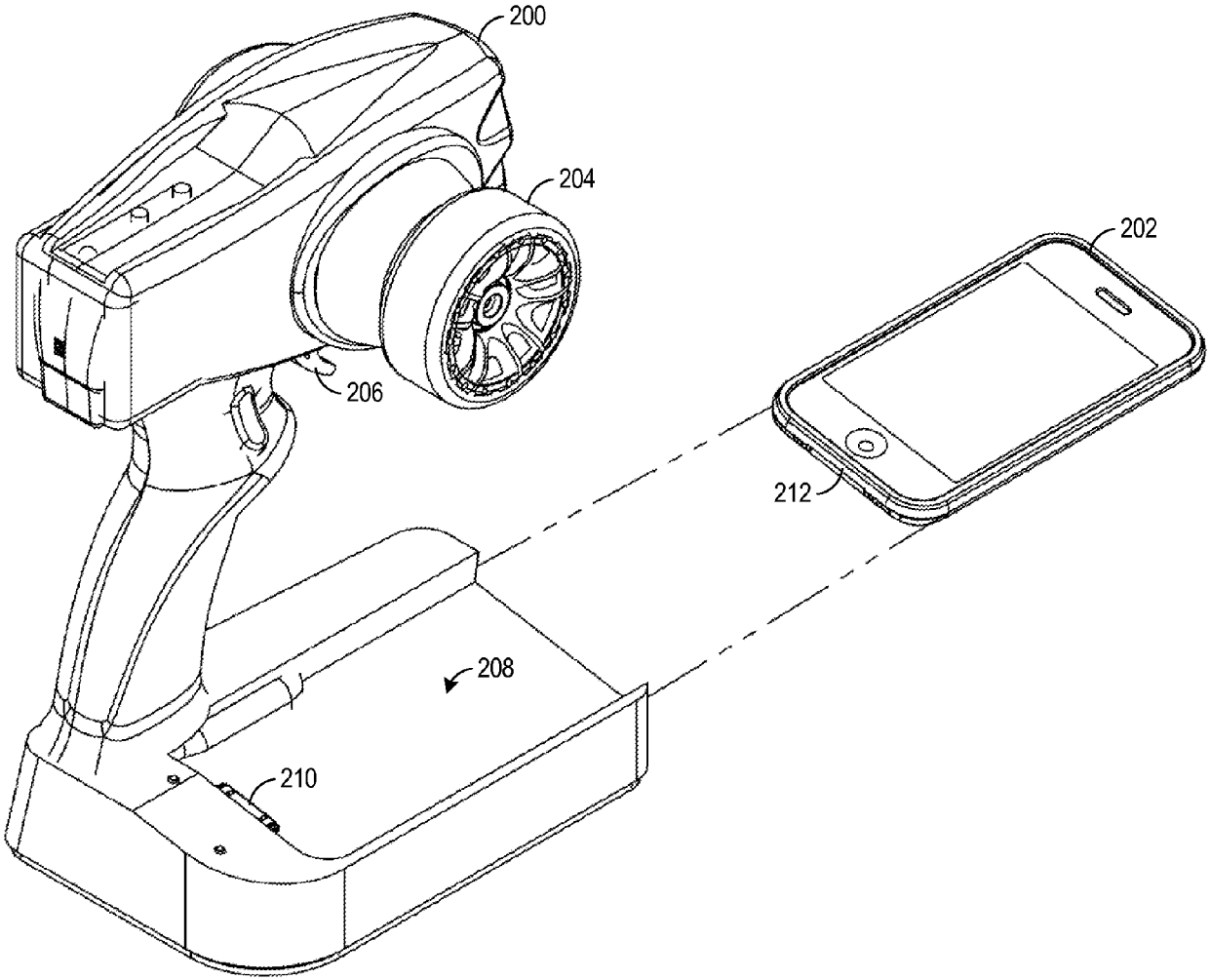
FIG. 2A depicts, to scale, a rear right perspective view of an exemplary portable electronic device exploded from an exemplary transmit controller.
Figure 2C:
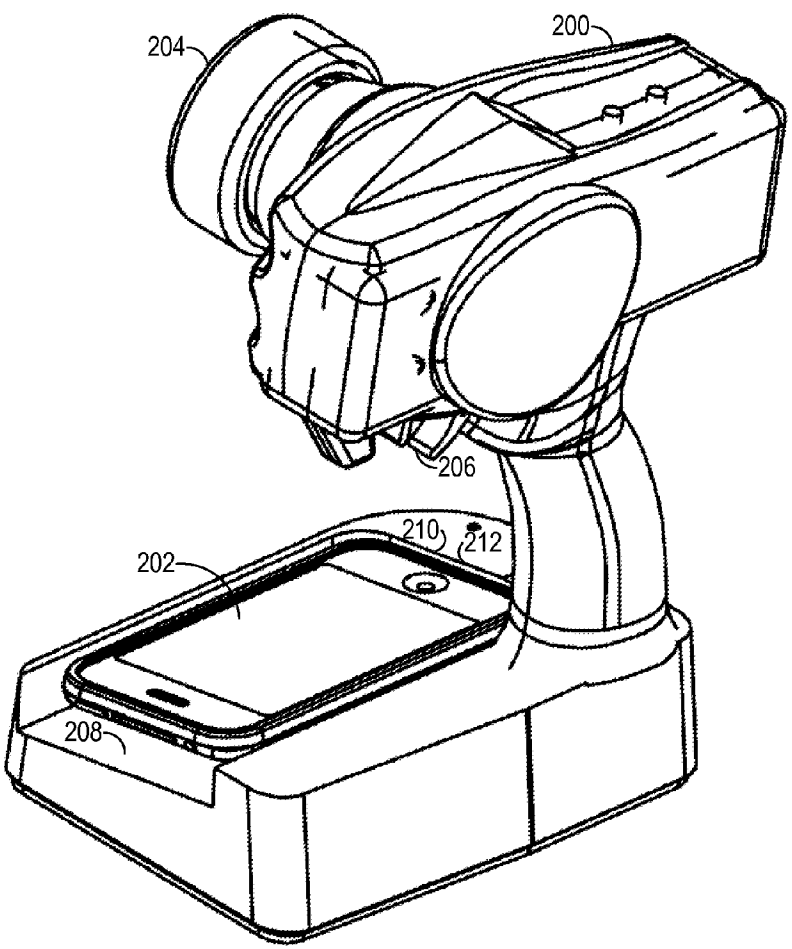
FIG. 2C depicts, to scale, a front left perspective view of an exemplary portable electronic device attached to an exemplary transmit controller.
Figure 2B:
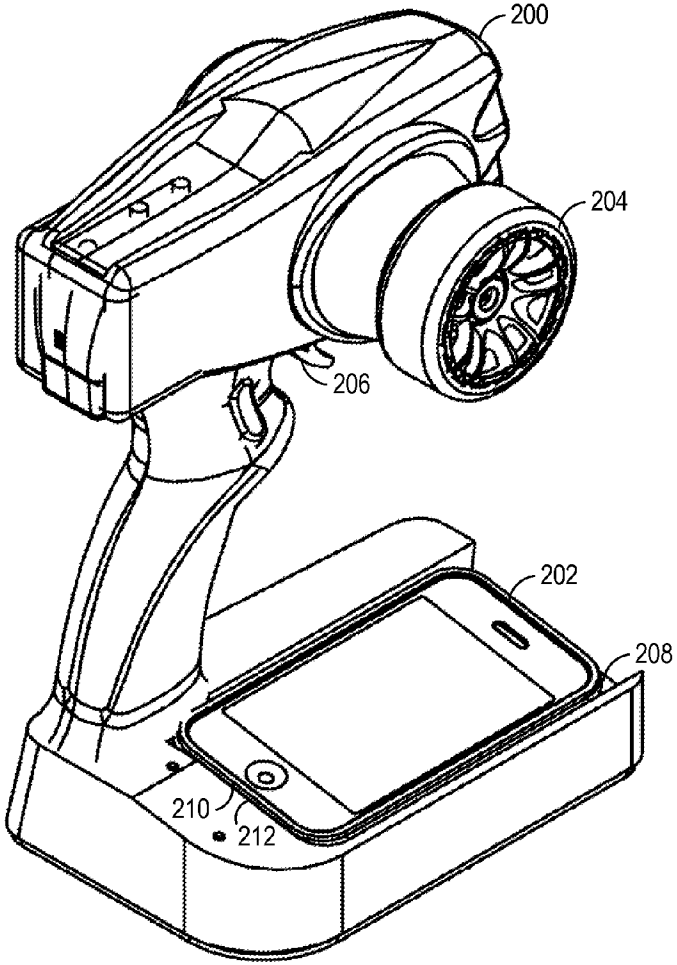
FIG. 2B depicts, to scale, a rear right perspective view of an exemplary portable electronic device attached to an exemplary transmit controller.
Figure 2E:
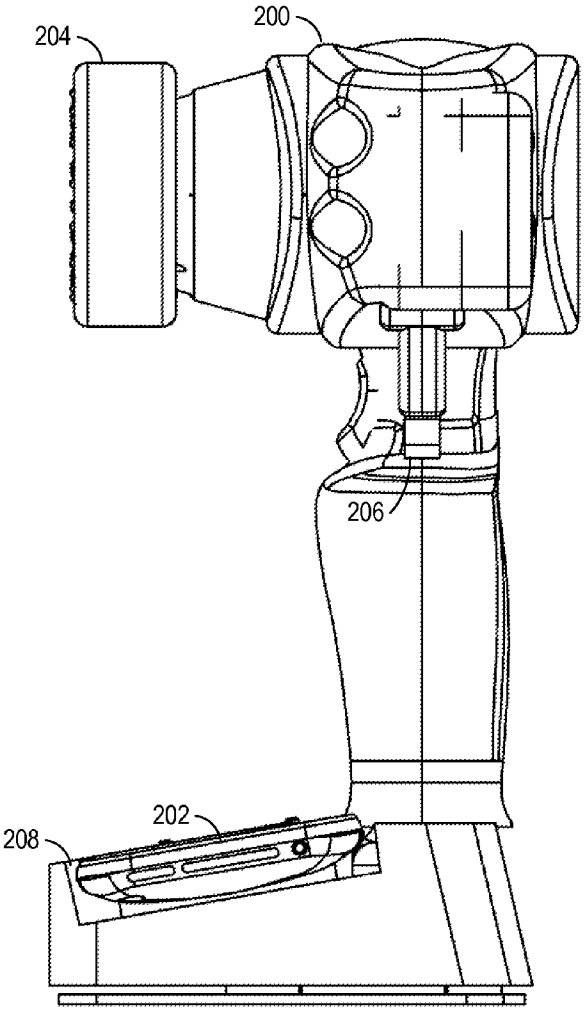
FIG. 2E depicts, to scale, a front view of an exemplary portable electronic device attached to an exemplary transmit controller.
Figure 2D:
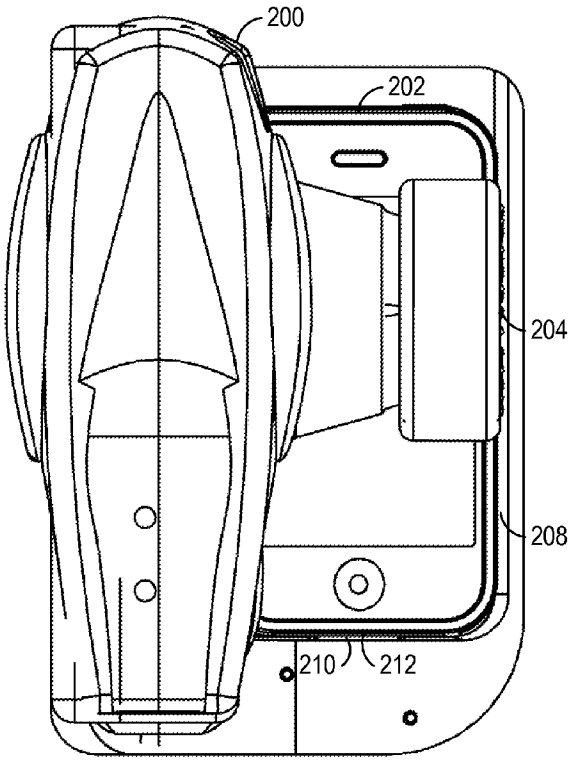
FIG. 2D depicts, to scale, an overhead view of an exemplary portable electronic device attached to an exemplary transmit controller.
Figure 2G:
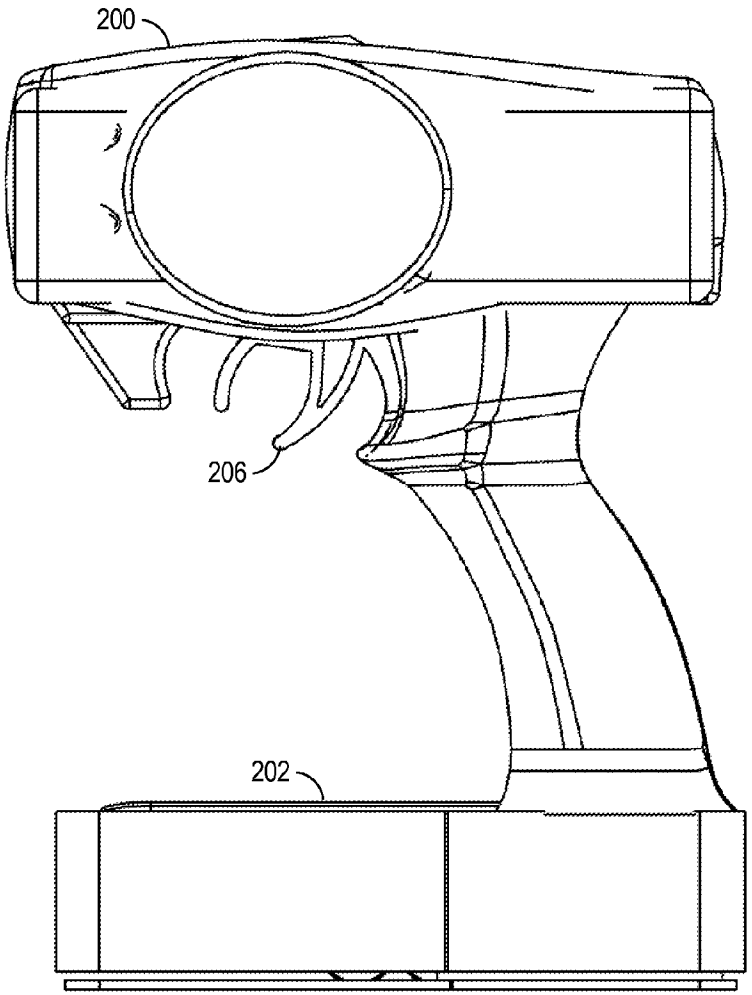
FIG. 2G depicts, to scale, a left side view of an exemplary portable electronic device attached to an exemplary transmit controller.
Figure 2F:
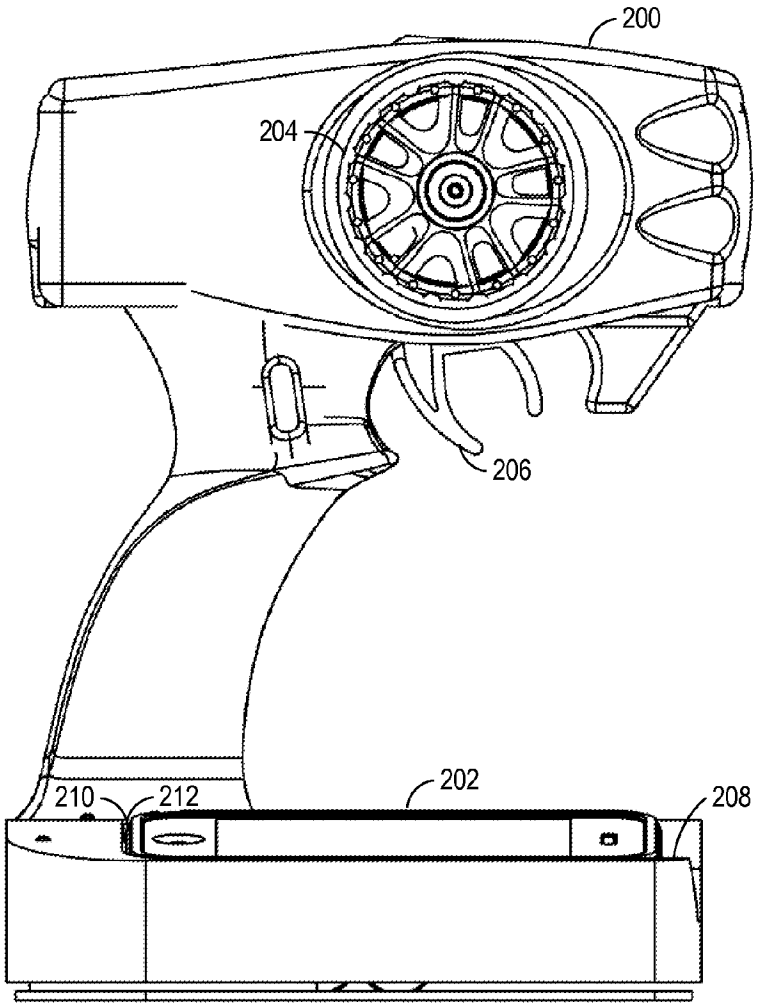
FIG. 2F depicts, to scale, a right side view of an exemplary portable electronic device attached to an exemplary transmit controller.

Transmit controller 200 has a base which supports steering wheel 204 and throttle trigger 206. As shown in FIG. 2A, a recess in the base forms a dock 208 having three walls which may hold portable electronic device 202 in place. Dock 208 has an auxiliary user interface connector 210 for connecting transmit controller 200 to external interface 212 of portable electronic device 202. As shown in FIGS. 2A and 2B, portable electronic device 202 may slide into dock 208, causing auxiliary user interface connector 210 to connect to external interface 212. In the embodiment of FIGS. 2A-2G, portable electronic device 202 connects directly into external interface 212. However, as described above, a cable or wireless connection could be used.

When connected, portable electronic device 202 may provide an auxiliary user interface for transmit controller 200. The auxiliary user interface may utilize a touch screen of portable electronic device 202 and provide additional input and output capabilities not available in the basic user interface of transmit controller 200. Dock 208 and auxiliary user interface connector 210 may be located where a user may easily see the screen of portable electronic device 202 while operating a model vehicle with steering wheel 204 and throttle control 206. The user may also operate the touch screen of portable electronic device 202 by moving the user's right hand from steering wheel 204 while continuing to grasp transmit controller 200 with the user's left hand.

Figure 3:
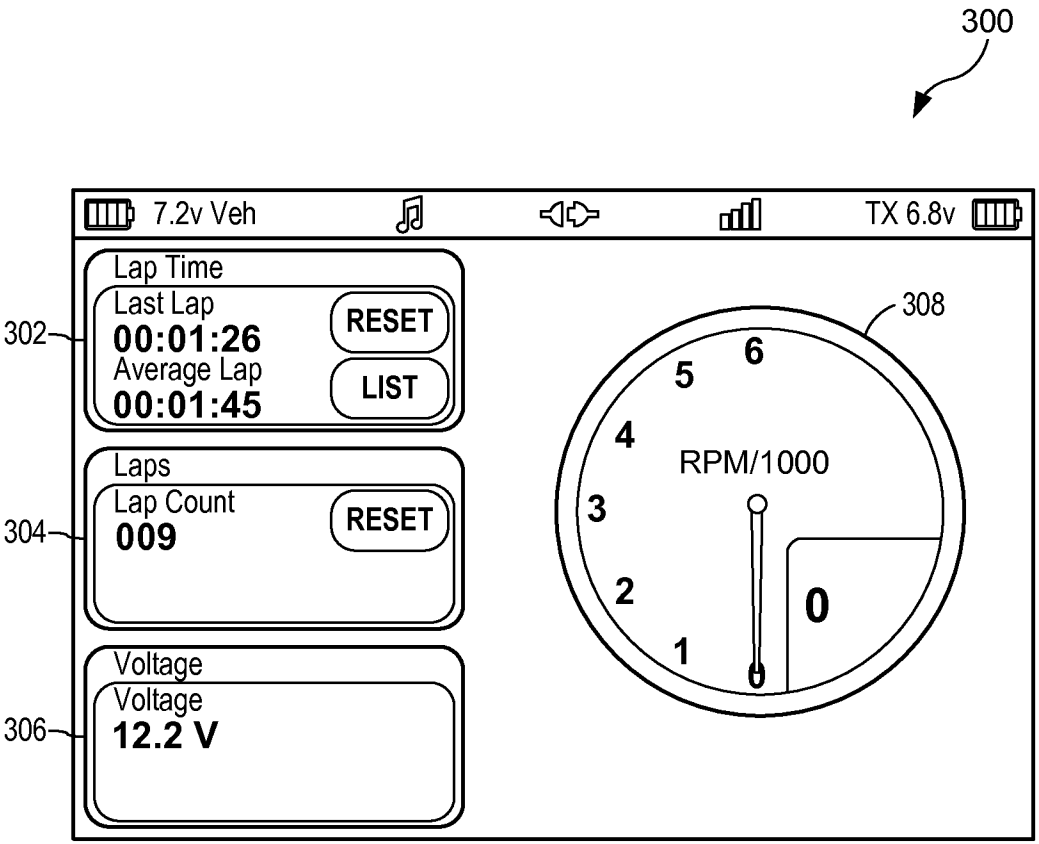
FIG. 3 depicts an exemplary portable electronic device user interface displaying telemetry data in accordance with an embodiment of the present invention.

With reference to FIG. 3, depicted is an exemplary portable electronic device user interface 300. Portable electronic device user interface 300 may have a high contrast color scheme, for better visibility in bright light. Portable electronic device user interface 300 includes panels 302, 304, 306, and 308. The user may specify the number, sizes, arrangement, and content of the panels displayed.

In user interface 300, panel 302 displays a lap timer, panel 304 displays a lap counter, panel 306 displays battery voltage, and panel 308 displays engine RPM. The size, number, arrangement, and content of the panels displayed by the user interface may be modified by the user. For instance, instead of the engine RPM shown in panel 308, the user might choose to display a second row of three panels to the right of the column having panels 302, 304, and 306. Some additional choices for content which may be displayed in a panel include motor temperature, vehicle speed, remaining laps, total elapsed time, and vehicle fuel level.

Notably, panel 308 includes a graphical display of an RPM dial. These graphical displays may be readily shown on the LCD display of a portable electronic device. However, showing such graphical displays on a transmit controller, which normally does not have a LCD display or equivalent, could require the inclusion of additional components, increasing the cost and complexity of the transmit controller.

Figure 4:
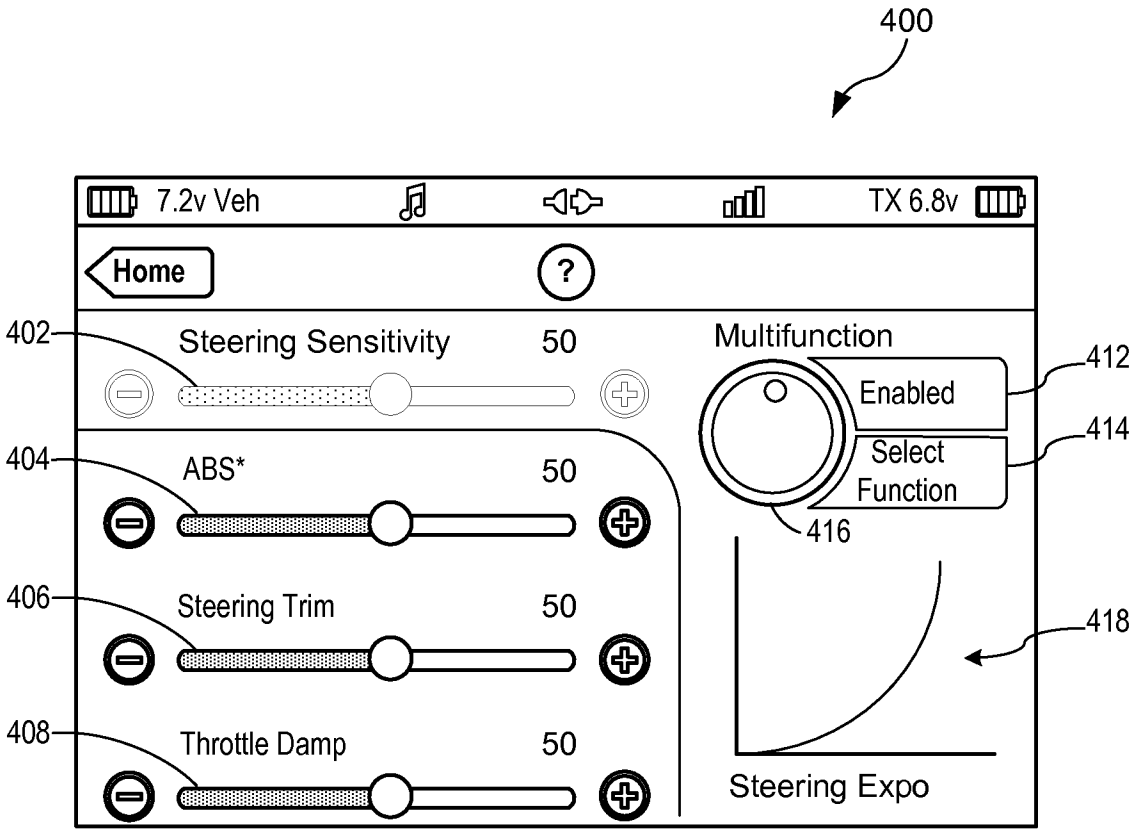
FIG. 4 depicts an exemplary portable electronic device user interface displaying sliders for modifying parameter settings in accordance with an embodiment of the present invention.

With reference to FIG. 4, depicted is a second exemplary portable electronic device user interface 400. Portable electronic device interface 400 may allow a user to modify the parameter settings stored in the memory of an attached transmit controller. Shown four sliders 402, 404, 406, and 408 which permit the user to set various parameters.

The parameters which may be set through a portable electronic device may be in addition to, or may overlap, the parameters which may be set through the parameter user interface of the associated transmit controller. In an exemplary embodiment, the mechanism on the built-in parameter user interface of transmit controller 104 for setting various parameters may be a dial called the MF (MultiFunction) Dial. Through the MF Dial and associated hardware, the user may select and modify a parameter.

In portable electronic device interface 400, only one of the MF Dial and portable electronic device interface 400 may control a given parameter at a particular time. Slider 402, the slider for steering sensitivity, is shown as disabled because it is being controlled by the MF Dial. The user may be required to use the MF Dial, rather than slider 402, to modify the steering sensitivity.

The user may press MF Dial Enabled Button 412 to disable MF Dial control of any parameter. Upon the user pressing MF Dial Enabled Button 412, slider 402 may become enabled, because the steering sensitivity is no longer being controlled by the MF Dial. All sliders 402, 404, 406, and 408 may then be usable.

The user may cycle through which parameter is controlled by the MF Dial by pressing Select Function Button 414. If the user were to press Select Function Button 414, the parameter controlled by the MF Dial may change from steering sensitivity to ABS*. Accordingly, slider 402 may become enabled and slider 404 may become disabled.

MF Dial Icon 416 may serve as a visual reminder that buttons 412 and 414 are associated with the MF Dial. Graph 418 provides the user with a graphical display of the parameter controlled by the MF Dial.

Figure 5:
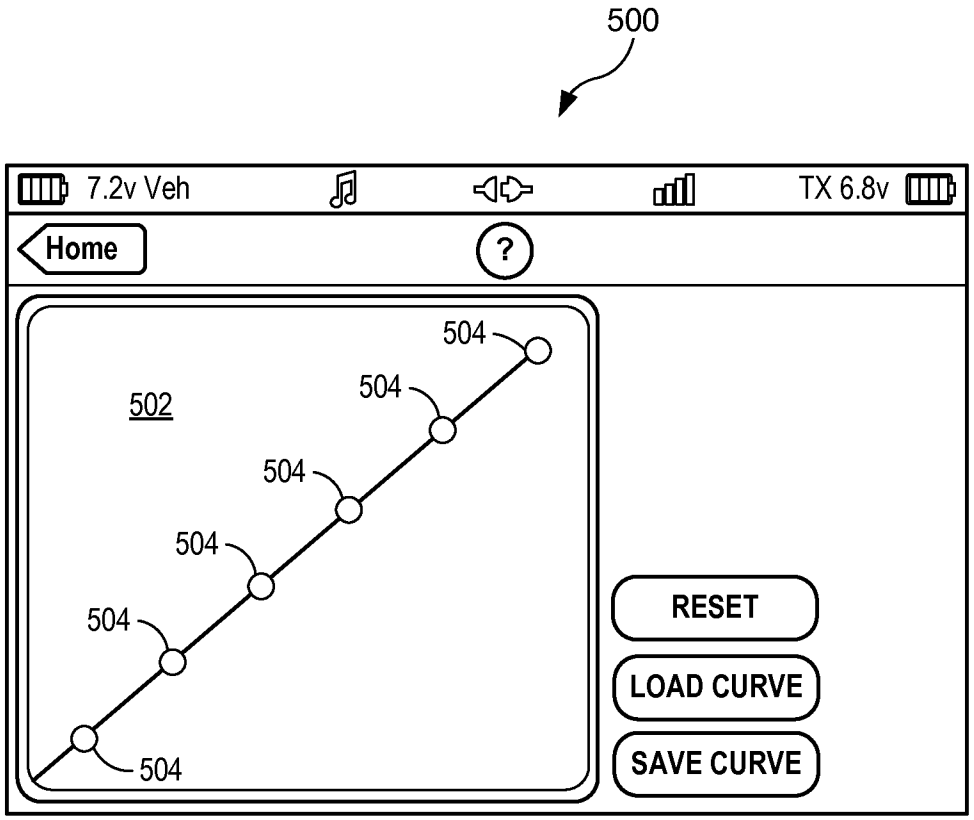
FIG. 5 depicts an exemplary portable electronic device user interface displaying a curve which the user may edit in accordance with an embodiment of the present invention.

Because a typical portable electronic device 102 may offer richer input and output functionality than a typical transmit controller 104, portable electronic device 102 may offer the user controls and feedback that would be impractical for transmit controller 104 alone to provide. With reference to FIG. 5, depicted is a user interface 500 for modifying a parameter which takes the form of a curve 502, such as an acceleration curve. Through user interface 500, a user may see the presently stored curve 502 and use a touch screen of portable electronic device 102 to modify it. The user may be able to visually place and drag points 504 on acceleration curve 502 with the touch screen. A similarly convenient user interface for modification of curve 502 may be difficult to achieve using only a transmit controller 104's built-in dials and LED's.

The present invention may provide improved input and output capabilities for a model vehicle transmit controller without significantly increasing the cost and complexity of the transmit controller. Instead, the transmit controller may have an auxiliary user interface connector, permitting a portable electronic device to serve as a detachable, auxiliary user interface for the model vehicle.

With reference to FIG. 6A, depicted is an exemplary method 600 of operating with an auxiliary user interface device in accordance with an embodiment of the present invention. At 602, a radio link may be created between a transmit controller and a model vehicle. At 604, at least one operational parameter may be stored in a memory of the transmit controller. At 606, an auxiliary user interface device may be connected to the transmit controller. This connecting may include connecting the auxiliary user interface to the transmit controller through a wireless connection. At 608, at least one operational parameter may be transmitted to the auxiliary user interface device. At 610, a parameter instruction may be received from the auxiliary user interface device. At 612, the at least one operational parameter may be modified in accordance with the parameter instruction. At 614, a control instruction may be received from a control user interface of the transmit controller. At 616, an output signal may be determined based on the control instruction and the at least one operational parameter. At 618, the output signal may be transmitted to the model vehicle through the radio link.

With reference to FIG. 6B, depicted are exemplary additional steps 620 and 622 which may be performed during method 600. At 620, a built-in parameter user interface of the transmit controller may be operated. At 622, the at least one operational parameter may be modified in accordance with the operation of the built-in parameter user interface.

Although the invention has been described with reference to a specific embodiment, these descriptions are not meant to be construed in a limiting sense. Various modifications of the disclosed embodiments, as well as alternative embodiments of the invention will become apparent to persons skilled in the art upon reference to the description of the invention. It is therefore contemplated that the claims will cover any such modifications or embodiments that fall within the true scope and spirit of the invention.

The invention claimed is:

1. A transmit controller compatible with an auxiliary user interface device, the transmit controller comprising:

a memory comprising a plurality of operational parameters;

a control user interface for controlling a model vehicle;

an auxiliary user interface connector for connecting to the auxiliary user interface device; and a transmit controller processor configured to:

receive a read command from the auxiliary user interface device, the read command instructing the transmit controller processor to provide to the auxiliary user interface device the value of a particular operational parameter in the memory;

in response to the write command, transmit the particular operational parameter to the auxiliary user interface device;

receive a write command from the auxiliary user interface device, the write command instructing the transmit controller processor to modify the value of the particular operational parameter in the memory;

in response to the write command, modify the value of the particular operational parameter in the memory;

receive a control instruction from the control user interface;

determine an output signal based on the control instruction and at least one of the plurality of operational parameters; and transmit the output signal to the model vehicle.

2. The transmit controller of claim 1, further comprising a dock configured to secure the auxiliary user interface device to the transmit controller when the transmit controller is connected to the auxiliary user interface connector.

3. The transmit controller of claim 1, wherein the dock comprises a recess in a base of the transmit controller.

4. The transmit controller of claim 1, wherein the auxiliary user interface connector comprises a wireless transceiver.

5. The transmit controller of claim 1, wherein the control user interface controls the steering and throttle of the model vehicle.

6. The transmit controller of claim 1, wherein the one or more operational parameters comprises a servo reversing parameter.

7. The transmit controller of claim 1, wherein the one or more operational parameters comprises an acceleration curve.

8. The transmit controller of claim 1, wherein the transmit controller processor is configured to modify the one or more operational parameters in accordance with an instruction from the auxiliary user interface device while the transmit controller comprises a radio link to a model vehicle.

9. The transmit controller of claim 1, wherein the transmit controller processor is configured to modify the one or more operational parameters in accordance with an instruction from the auxiliary user interface device while the control user interface is operable to control the model vehicle.

10. The transmit controller of claim 1, wherein the transmit controller processor is further configured to:

receive a telemetry signal from the model vehicle; and provide the telemetry signal to the auxiliary user interface device.

11. The transmit controller of claim 10, wherein the telemetry signal represents one of the group consisting of motor temperature, motor RPM, vehicle speed, battery voltage, and fuel level.

12. The transmit controller of claim 1, wherein the auxiliary user interface device comprises a portable electronic device.

13. The transmit controller of claim 1, wherein the auxiliary user interface device comprises a mobile phone.

14. The transmit controller of claim 1, wherein the auxiliary user interface device comprises a personal digital assistant.

15. The transmit controller of claim 1, wherein the auxiliary user interface device comprises a digital music player.

16. The transmit controller of claim 1, wherein the auxiliary user interface device has a smaller physical volume than the transmit controller.

17. The transmit controller of claim 1, wherein the processor is configured to determine the output signal at least by determining, based on the one or more operational parameters, whether to modify the control signal.

18. The transmit controller of claim 1, wherein the processor is configured to determine the output signal at least by determining, based on the one or more operational parameters, how to modify the control signal.

19. The transmit controller of claim 1, further comprising a built-in parameter user interface for modifying the one or more operational parameters.

20. The transmit controller of claim 19, wherein at least a portion of the built-in parameter user interface becomes inoperable when the auxiliary user interface device is connected to the auxiliary user interface connector.

21. A method of operating with an auxiliary user interface device comprising:

creating a radio link between a transmit controller and a model vehicle;

storing a plurality of operational parameters in a memory of the transmit controller;

connecting an auxiliary user interface device to the transmit controller;

receiving a read command from the auxiliary user interface device, the read command comprising an instruction to provide to the auxiliary user interface device the value of a particular operational parameter in the memory;

in response to the read command, transmitting the particular operational parameter to the auxiliary user interface device;

receiving a write command from the auxiliary user interface device, the write command comprising an instruction to modify the value of the particular operational parameter in the memory;

in response to the write command, modifying the value of the particular operational parameter in the memory;

receiving a control instruction from a control user interface of the transmit controller;

determining an output signal based on the control instruction and the at least one operational parameter; and transmitting the output signal to the model vehicle through the radio link.

22. The method of claim 21, further comprising:

operating a built-in parameter user interface of the transmit controller; and modifying the at least one operational parameter in accordance with the operation of the built-in parameter user interface.

23. The method of claim 21, wherein the connecting the auxiliary user interface device to the transmit controller comprises:

connecting the auxiliary user interface device to the transmit controller through a wireless connection.

24. The method of claim 21, wherein the modifying the at least one operational parameter in the memory of the transmit controller occurs during the radio link with the model vehicle.

* * * * *

UNITED STATES PATENT AND TRADEMARK OFFICE

CERTIFICATE OF CORRECTION

PATENT NO. : 9,004,977 B2
APPLICATION NO. : 12/850453
DATED : April 14, 2015
INVENTOR(S) : DeWitt et al.

It is certified that error appears in the above-identified patent and that said Letters Patent is hereby corrected as shown below:

In the Claims:
Claim 1, Column 9, line 31 is corrected to read as follows:

"in response to the read command, transmit the particular operational parameter to the auxiliary user interface device;"

Signed and Sealed this
Twenty-second Day of September, 2015

Michelle K. Lee

Michelle K. Lee
*Director of the United States Patent and Trademark Office*